United States Patent [19]

Honma et al.

[11] 4,425,205

[45] Jan. 10, 1984

[54] PROCESS FOR REGENERATING ELECTROLESS PLATING BATH AND A REGENERATING APPARATUS OF ELECTROLESS PLATING BATH

[75] Inventors: Hideo Honma, Yokohama; Yoshiaki Suzuki; Yasuhiro Matsumoto, both of Yokosuka, all of Japan

[73] Assignees: Kanto Kasei Co., Ltd.; Facility Ltd., both of Kanagawa, Japan

[21] Appl. No.: 372,133

[22] Filed: Apr. 27, 1982

[30] Foreign Application Priority Data

Mar. 13, 1982 [JP] Japan ..... 57/39869
Apr. 23, 1982 [JP] Japan ..... 57/67364

[51] Int. Cl.[3] ..... C02F 1/46; B01D 13/02

[52] U.S. Cl. ..... 204/151; 204/131; 204/302; 204/DIG. 13

[58] Field of Search ..... 204/72, 131, 149, 151, 204/302, DIG. 13

[56] References Cited

U.S. PATENT DOCUMENTS

| | | | |
|---|---|---|---|
| 3,470,044 | 9/1969 | Radimer | 204/151 |
| 4,144,149 | 3/1979 | Bollhalder | 204/DIG. 13 |
| 4,208,255 | 6/1980 | Slahl | 204/72 |
| 4,324,629 | 4/1982 | Oka | 204/DIG. 13 |
| 4,337,129 | 6/1982 | Sohoroff | 204/151 |

FOREIGN PATENT DOCUMENTS

| | | | |
|---|---|---|---|
| 2479856 | 10/1981 | France | 204/DIG. 13 |

*Primary Examiner*—John F. Niebling
*Attorney, Agent, or Firm*—Murray and Whisenhunt

[57] ABSTRACT

A process for regenerating electroless plating bath comprising the steps of:

(i) continuously or intermittently taking out a part or the whole of chelating agent-containing copper electroless plating bath from an electroless plating tank, followed by removing off the copper ion content from said bath;

(ii) acidifying the thus obtained solution for precipitating the chelating agent therefrom and recovering the precipitated chelating agent;

(iii) supplying said recovered chelating agent to an anodic cell separated by an exchange membrane from a cathodic cell having cathode, said anodic cell having copper anode, wherein in case a neutral or alkaline electrolyte solution is supplied to said cathodic cell said partitioning membrane is an anion exchange membrane or cation exchange membrane, while in case an acidic electrolyte solution is supplied to said cathodic cell said partitioning membrane is a cation exchange membrane, and applying direct current between both electrode; and (iv) then, recycling the solution within said anodic cell to said electroless plating tank, and a regenerating apparatus of electroless plating bath including (a) a copper-precipitating means for decomposing the copper chelate contained in the electroless copper plating bath and for precipitating the copper ion, (b) a chelating agent-recovering means for changing the pH of the solution to precipitate the chelating agent and recover, and (c) an electrolytic means comprising an anodic cell and a cathodic cell separated by means of an ion exchange membrane, said anodic cell having a copper anode therein, said cathodic cell having a cathode therein.

22 Claims, 5 Drawing Figures

PROCESS FOR REGENERATING ELECTROLESS PLATING BATH AND A REGENERATING APPARATUS OF ELECTROLESS PLATING BATH

BACKGROUND OF THE INVENTION (1) Field of the Invention

The present invention relates to a process for regenerating electroless plating bath containing a chelating agent such as ethylenediaminetetraacetic acid (EDTA) or the like and an apparatus therefor, in particular relates to a process for regenerating electroless plating bath which comprises supplying the copper ion resultant from anode dissolution in the form of an EDTA-copper complex by virtue of the chelating agent recovered from the plating bath and an apparatus used therefor.

(2) Description of the Prior Art

Electroless plating, irrespective of whether it is used as the under-coating for electroplating or it is used by itself, is accompanied with accumulation of by-products in the plating bath resulting from the consumption of copper ion, pH modifier i.e. hydrate ion and reductant. This phenomenon should be said unavoidable because electroless plating reaction is an inversible reaction.

On the other hand, the quality of electroless copper plated film depends widely on the plating bath composition and the plating conditions. That is, with the increase of salt concentration due to the by-products in plating bath, the characteristics and quality of electroless copper plated film deteriorate and additionally the rate of plating reaction varies.

In the electroless copper plating for printed wiring board, in particular the printed wiring board prepared by semi-additive process or full-additive process, it is required that the resulting electroless plated film should possess exceedingly superior physical properties as compared with those of the electroless plated film, acting merely as only a conductive thin film for a through-hole, that is, prepared by conventional subtractive process wherein the through-hole and the circuits are mostly formed by electrolytic copper plating. That is to say, if the physical properties of electroless copper plated film are not equivalent to those of the copper film formed by electro plating, of which copper pyrophosphate plating bath and copper sulfate plating bath are typical, it will be impossible to obtain the printed wiring board equivalent in quality to that prepared by electro copper plating, and controlling of the deposition rate of electroless copper plating comes to be of great importance in the point of the control of the plated film feature. In view of this, it becomes necessary to control the electroless copper plating bath composition so as to maintain its concentration as uniform as possible and further to reduce reaction by-products as little as possible.

Controlling of bath concentration has hitherto been conducted by adding thereto separately prepared copper sulfate solution, sodium hydroxide solution and reductant such, for instance, as solid or liquid formaldehyde respectively in fixed quantities when the concentrations of components such as $Cu^{2+}$, $OH^{-}$, and reductant, which decrease with the progress of electroless plating reaction, in the bath are conjectured to have reached predetermined concentrations by manual or automatic analysis or from the treated mass of the substrate and times required for plating.

On the other hand, this comes to cause accumulation of sodium sulfate, sodium formate and further alcohols such as methanol, ethanol and the like. Taking account of the fact that the number of rejects of the plated products increases as these reaction by-products increase, it has been adopted by experience to disuse a part or the whole of the bath which has been used up to a certain bath life and use a fresh plating bath.

However, this way is defective in that it is not only expensive but also likely to bring about irregularity of the quality, deteriorated productivity and the like, and additionally involves problems to be settled especially when the electroless plated film of high quality as mentioned above is demanded. Further, the exchange of plating bath involves a problem on treatment of the spent bath. In more detail, at that time it becomes necessary to consider treatment for rendering the chelating agent contained in the spent bath nonpoisonous such, for instance, as COD counterplan, BOD counterplan and the like against the said chelating agent. Accordingly, it is feared that this way not only brings about increase of expenses for making the said chelating agent nonpoisonous but shall be unable to cope with the social circumstances where the disuse of spent bath per se is getting difficult from the viewpoint of environmental pollution regulation.

SUMMARY OF THE INVENTION

It is an object of the present invention to eliminate the above mentioned drawbacks inherent in the prior art and to provide a process for regenerating electroless plating bath which is capable of decreasing the accumulation of reaction by-products so as to carry out stable electroless plating and dealing with the problem of treating the spent bath solution widely and an apparatus therefor.

The process for regenerating electroless plating bath according to the present invention is characterized by comprising the following steps (i) to (iv):

(i) the step of continuously or intermittently taking out a part or the whole of chelating agent-containing copper electroless plating bath from an electroless plating tank, followed by removing off the copper ion content from said bath, (ii) the step of acidifying the thus obtained solution for precipitating the chelating agent therefrom and recovering the precipitated chelating agent, (iii) the step of supplying said recovered chelating agent to an anodic cell separated by an exchange membrane from a cathodic cell having cathode, said anodic cell having copper anode, wherein in case a neutral or alkaline electrolyte solution is supplied to said cathodic cell said partitioning membrane is an anion exchange membrane or cation exchange membrane, while in case an acidic electrolyte solution is supplied to said cathodic cell said partitioning membrane is a cation exchange membrane, and applying direct current between both electrode, and (iv) the step of recycling the solution within said anodic cell to said electroless plating tank.

And, the regenerating apparatus of electroless plating bath is characterized by including the following means (a) to (c) as constitutional elements:

(a) a copper-precipitating means for decomposing copper chelate contained in the electroless copper plating bath and for precipitating the copper ion, (b) a chelating agent-recovering means for changing the pH of the solution to precipitate the chelating agent and recover, and (c) an electrolytic means comprising an anodic cell and a cathodic cell separated by means of an ion exchange membrane, said anodic cell having a copper anode therein, said cathodic cell having a cathode therein.

Figure 1:
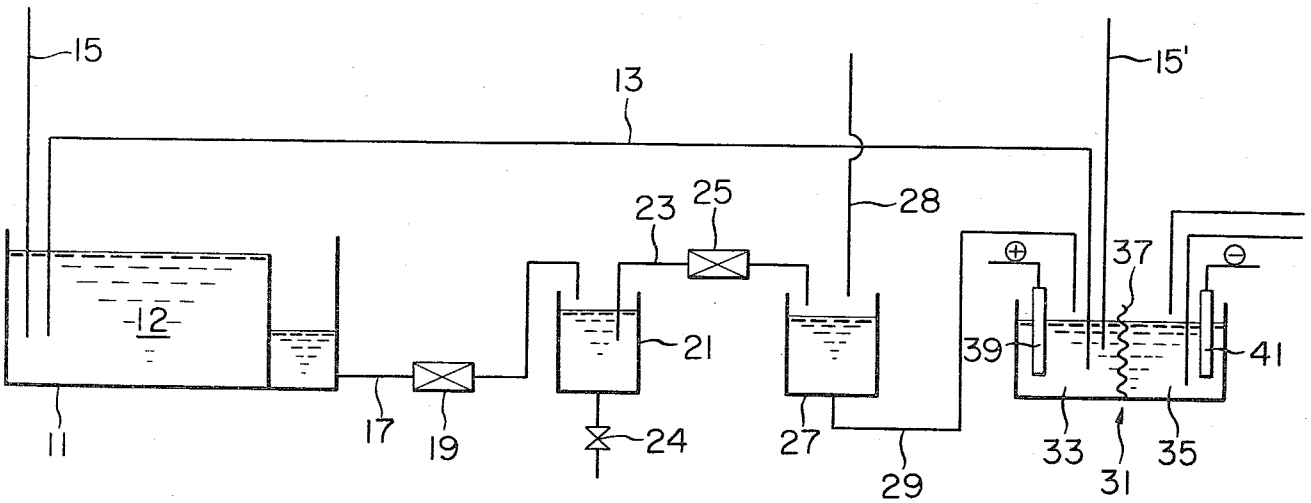
FIG. 1 is a flow view illustrating the present invention.

12 . . . electroless plating bath
21 . . . copper-precipitating device
27 . . . chelating agent-recovering device
31 . . . electrolytic device
37 . . . ion-exchange membrane
39 . . . anode
41 . . . cathode

DETAILED DESCRIPTION OF THE INVENTION

FIG. 1 is a flow view of the present invention. An electroless plating bath 12 may contain copper ion, hydrate ion (pH modifier), reductant and chelating agent, and further may contain various assistants. With the progress of electroless copper plating, the copper ion, hydrate ion and reductant are consumed, while sodium formate and methyl alcohol (in case formaldehyde is used as reductant) are by-produced. And, in case copper ion is added as copper sulfate and hydrate ion is added as sodium hydroxide, sodium sulfate comes to accumulate. Thereafter, the consumed quantity is supplied from a cycling system and a non-cycling system through lines 13 and 15 respectively, and simultaneously a part or the whole of plating bath (containing by-products) is taken out of the plating tank 11 continuously or intermittently. The term "intermittently" used herein includes a case of taking out the plating bath irregularly irrespective of a predetermined cycle.

FIG. 1 shows the instance where a part of the plating bath is taken out continuously by overflowing in accordance with the supplied quantity. The plating bath taken out by overflowing passes along a line 17 and is introduced in a copper-precipitating device 21 from an inlet via a filter 19 (which is omissible). In the copper-precipitating device 21, the copper ion is precipitated and removed. Separation of the copper ion may be conducted by decomposing the copper chelate and precipitating the copper in the form of metal copper or copper oxide according to one of the following methods or a combination of two or more thereof:

(1) adding metal copper in the form of copper plate, copper foil, copper powder or the like in the bath, (2) adding a catalyst such as $Pd^{2+}$ or the like in the bath, and (3) maintaining the bath at a high temperature and a high pH.

Removal of copper may be achieved by electrolytic removal besides above mentioned precipitating removal. The copper ion contained in said bath may be removed therefrom, for instance, in the manner of having insoluble anode and cathode in the electroless copper plating liquid to be treated and applying direct current for depositing the copper on the cathode.

Accordingly, the copper-precipitating device 21 may include, by request, a member for pouring copper powder, $Pd^{2+}$, alkali agent and the like or a member for heating them and may further include a member for stirring them in order to accelerate the above reaction. In addition, it is possible to have anode and cathode in the copper-precipitating device 21. The thus precipitated copper is discharged from a valve 24 as the occasion may demand.

The thus obtained solution, from which the copper ion has been precipitated and removed, passes through an outlet and is introduced in a chelating agent-recovering device 27 through a line 23 via a filter 25 (which is omissible). An acid can be introduced in the chelating agent-recovering device through a line 28 so as to render the pH of the solution within this device acidic enough to precipitate the chelating agent therefrom. The suitable pH range, although variable depending on the chelating agent, is generally 4.0 or less for instance when the chelating agent is EDTA, preferably 2.0 or less, more preferably 1.0 or less. Usual acids may be employed for the purpose of controlling the pH. As said acids there can be enumerated sulfuric acid, hydrochloric acid and the like.

Figure 2:
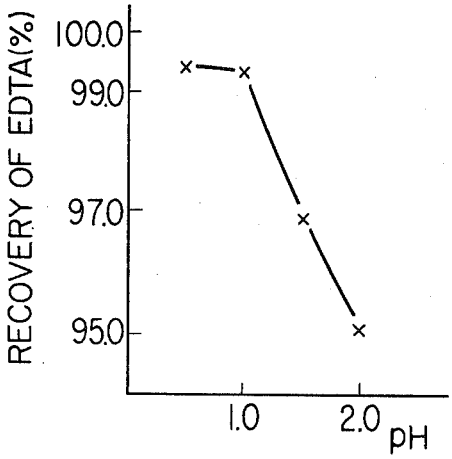
FIG. 2 is a graph illustrating the rate of recovery of EDTA.

FIG. 2 is a graph illustrating the relation between the rate of recovery and pH in the case of having used EDTA as the chelating agent. It can be seen therefrom that EDTA can be recovered fully at the pH of 2.0 or less, and more preferable recovery can be achieved at the pH of 1.0 or less. In this connection, it is to be noted that controlling of pH has been done with sulfuric acid in the present instance.

As is evident from the above stated, separation of the chelating agent from the electroless copper plating bath can be achieved by decomposing the copper chelating agent to thereby remove the copper content and removing the chelating agent. As the chelating agent applicable to this process there can be enumerated, in addition to EDTA, many known ones for use in electroless copper plating such as potassium sodium tartrate (Rochelle salt), ethylenediaminetetramine, triethanolamine, diethanolamine and the like.

The recovered chelating agent is introduced through a line 29 into an anodic cell 33 of an electrolytic device 31. In this instance, the chelating agent may be washed and further dried as occasion demands. Further, the recovered chelating agent may be supplied to the anodic cell 33 in a solid state, and may also be introduced to the anodic cell 33 of the electrolytic device 31 in the state of solution having previously been dissolved in an alkali solution.

The electrolytic device 31 comprises the anodic cell 33 and cathodic cell 35 partitioned by means of an ion exchange membrane 37. And, in the anodic cell 33 there is disposed a copper anode 39, while in the cathodic cell 35 there is disposed a cathode 41. The cathode 41 is preferably made of the material to be insoluble in a cathodic electlyte, such as stainless, carbon or the like.

In the anodic cell 33 there is supplied the recovered chelating agent in the solid or liquid state. Its pH is maintained at such a value that the chelating agent is soluble in the solution in the anodic cell 33, or anodic electlyte. For instance, in the case of EDTA the pH value is generally 4.0 or more, preferably 7.0 or more.

The cathodic cell 35 may contain an alkaline, neutral or acidic electrolyte solution. In case a neutral or alkaline electrolyte solution is supplied into the cathodic cell 35; the partitioning membrane 37 may be either an anion exchange membrane or a cation exchange membrane, while in case an acidic electrolyte solution is supplied into the cathodic cell 35, the partitioning membrane 37 is a cation exchange membrane. Conversely speaking, when the ion exchange membrane 37 is cathodic, the electrolyte solution contained in the cathodic cell 35 may be either alkaline, neutral or acidic, while when the membrane 37 is anodic, the electrolyte solution is neutral or alkaline.

When electrolysis is carried out by applying direct current between both electrodes, namely between anode 39 and cathode 41, the copper is subjected to anodic dissolution and the copper ion is generated in the anodic cell 33. At the same time, this ion forms a copper complex compound in conjunction with a chelating agent supplied through a line 29. In succession, this copper complex compound is recycled from a line 13 to an electroless plating tank 11. The current density may be generally in the range of 0.01 to 100 $A/dm^2$.

In case the pH of solution within the cathodic cell 35 is alkaline and an anion exchange membrane is used, with the progress of electrolysis the $OH^-$ ion passes through the ion exchange membrane 37 (anion exchange membrane) and arrives at the anodic cell 33, and consequently the consumed copper ion (in the form of a complex compound) and hydrate ion are supplied into the plating tank 11 through the line 13. This case is very convenient in that the hydrate ion necessary for electroless plating is supplied together with the copper ion. While a cation exchange membrane is commercially more available than and anion one.

In case the pH of solution within the cathodic cell 35 is acidic or neutral, or the ion exchange membrane 37 is cathodic, there is no OH-ion to be supplied from said cell. Although there is necessity of supplying it separately, it may be readily supplied in the form of NaOH or the like.

As is evident from the above mentioned, the copper ion (in the form of a complex) or further the $OH^-$ ion is supplied from the line 13, and the reductant and the required assistants are supplied from the line 15 or 15' through the line 13. The above explanation was made on the case where separation of copper ion, recovery of chelating agent, and dissolution of copper ion by electrolysis are operated in separate tanks. However, it is to be noted that the above mentioned respective operations may be done in one tank.

Figure 3:
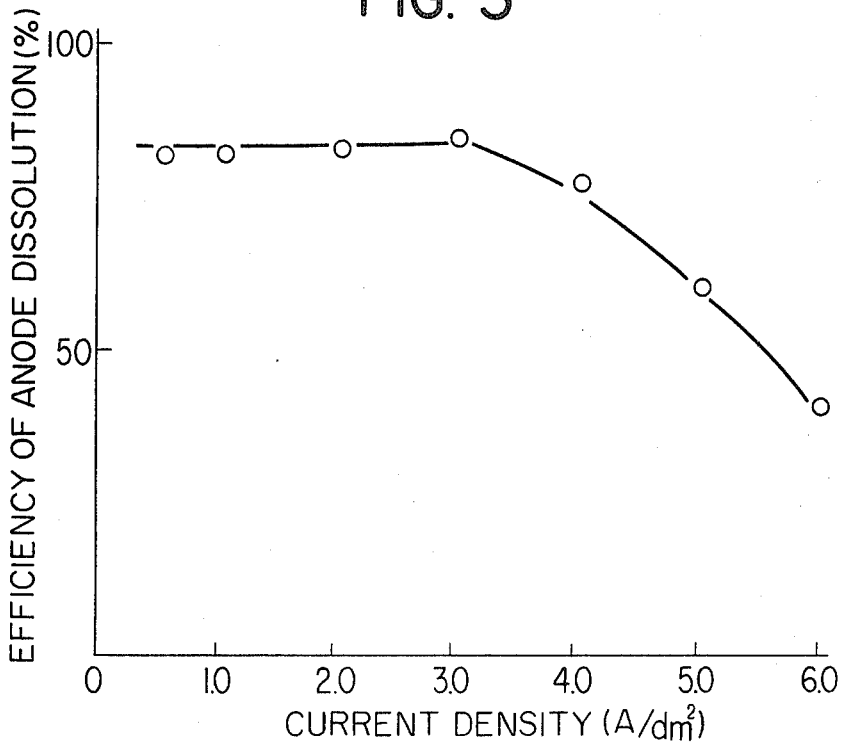
FIG. 3 is a graph illustrating the relation between current density and the efficiency of anode dissolution.

FIG. 3 a graph illustrating the relation between the current density and efficiency of anode dissolution. This was effected at 50° C. of liquid temperature by using the electrolytic device illustrated in FIG. 1 in which the ion exchange membrane is an anion exchange membrane, pouring 0.08 mol/l of EDTA. 4 Na in the anodic cell and 0.1 mol/l of NaOH in the cathodic cell and using 0.5 $dm^2$ of copper plate as the anode and 0.5 $dm^2$ of 18-8 stainless as the cathode.

Figure 4:
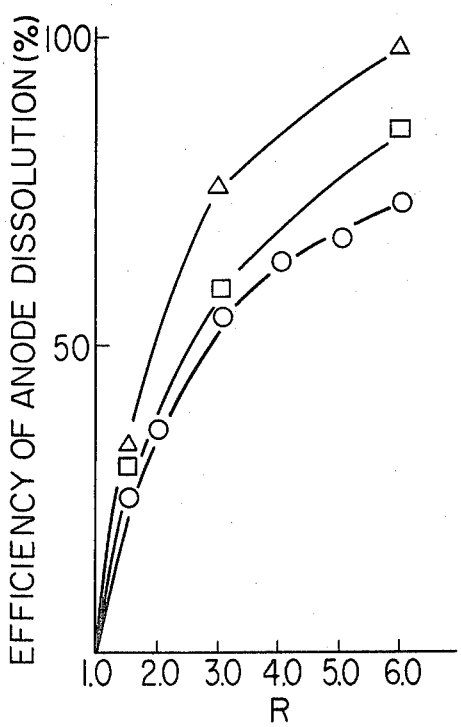
FIG. 4 is a graph illustrating the relation between the concentration ratio R of copper ion to EDTA and the efficiency of anode dissolution.

FIG. 4 is a graph illustrating the relation between the concentration ratio R of copper ion to EDTA ($R=[EDTA]/[Cu^{2+}]$) and the efficiency of anode dissolution. This was effected according to the exactly same procedure as in FIG. 3 except that the concentration of EDTA was varied. It can be seen therefrom that in case the concentration of EDTA, the chelating agent for copper, is high, the copper dissolves so much with high current efficiency. Accordingly, dissolution and supply of the copper can be effected with high efficiency by maintaining the pH of the chelating agent more than the predetermined value.

Figure 5:
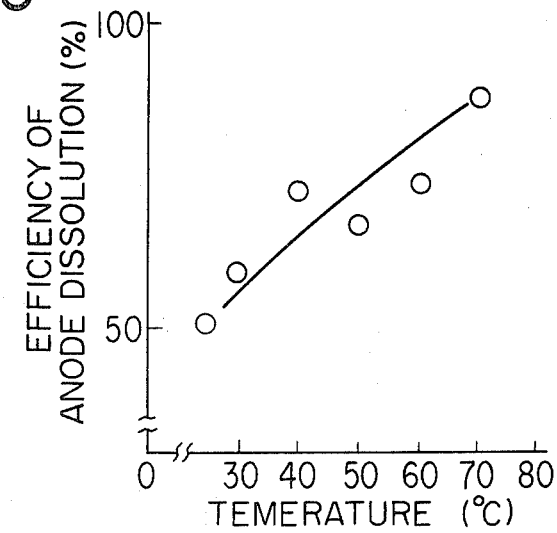
FIG. 5 is a graph illustrating the relation between the anodic electlyte temperature and the anode efficiency.

FIG. 5 is a graph illustrating the relation between the liquid temperature in the anodic cell and the efficiency of anode dissolution. This was conducted under the conditions: both cell compositions identical with those in FIG. 2, current strength 2A, quantity of electricity applied 3600 coulombs, anodic current density $3A/dm^2$, and cathodic current density $4A/cm^2$. It can be seen therefrom that in case the liquid temperature in the anodic cell is higher, the copper dissolves with so much higher current efficiency. Accordingly, the present invention is more effective in the preparation of, for instance, printed wiring boards using electroless plating. The reason is that in the electroless plating where high plating speed and physical properties of plated film are demanded strictly, it is ideal to use the plating bath under exceedingly high temperature conditions.

Experiments were accomplished on efficiency of anode dissolution using other combinations of an ion exchange membrane and an electrolyte solution contained in the cathodic cell, that is, a cation exchange membrane and an acidic, neutral or alkaline electrolyte solution as well as an anion exchange membrane and a neutral electrolyte solution, obtaining the result similar to that showed FIGS. 3 to 5.

As explained above, the present invention, which comprises taking out at least a part of the electroless plating bath from an electroless plating tank, recovering the chelating agent therefrom and supplying the consumed copper portion in the form of the copper complex compound by means of this recovered chelating agent, can markedly reduce the accumulation of the by-products such as sodium sulfate, sodium formate and alcohols in the electroless copper plating bath, in the extreme the accumulation of sodium sulfate being substantially reduced into zero, whereby the life of the electroless plating bath can be prolonged very much and high quality electroless plating film can be obtained stably. In the prior art, the COD and BOD counterplanes of waste plating bath have brought about serious environmental pollution problems. According to the present invention, contrarily, the plating bath life is prolonged, which dispenses with disuse of the bath and further makes it possible to recover precious chelating agents such as EDTA and reutilize them effectively.

DESCRIPTION OF THE PREFERRED EMBODIMENTS

Experiment Example

| | |
|---|---|
| EDTA.4Na | 30 g/l |
| $CuSO_4.5H_2O$ | 6 g/l |
| Para-formaldehyde | 7 g/l |
| pH (controlled with NaOH) | 11.8 |

Glass-epoxy copper-clad laminates were electroless-plated by using the above prescribed bath composition (bath volume; 5 l) at 50° C. At this time, sodium sulfate was added to the bath in quantities as shown in Table 1 to observe the influence caused thereby.

TABLE 1

| Quantity of $Na_2SO_4.5H_2O$ added | Rate of deposition (μm/hr) | Crack-forming rate G 10 |
|---|---|---|
| 0 [g/l] | 2.9 | 0/30 |
| 15 [g/l] | 3.3 | 7/15 |
| 45 [g/l] | 3.5 | 15/15 |
| 75 [g/l] | 3.9 | 15/15 |

It can be seen from Table 1 that the rate of deposition varies depending on the quantities of sodium sulfate added and that the crack-forming rate increases as the quantities of sodium sulfate increase.

Example

Glass-epoxy copper-clad laminates were defatted with 40 g/l of sodium trihydrogen phosphate, etched with 100 g/l of ammonium persulfate, activated with a colloidal solution of palladium and tin and then with 50 g/l of sulfuric acid, and thereafter electroless-plated at a load of 1 $dm^2$/ 1 for 12 days in accordance with the present process and the conventional one under the following conditions:

| Bath composition | |
|---|---|
| copper sulfate | 10 g/l |
| EDTA | 50 g/l |
| Formaldehyde | 10 g/l |
| Sodium hydroxide | pH controlled to be 12 |
| Bath temperature 50° C. | |

In the conventional process, the supply of copper ion and hydrate ion was effected in the manner of supplementing copper sulfate and sodium hydroxide, whereby the concentration of sodium sulfate increased. The process of the present invention was carried out in the manner of using the system shown in FIG. 1, using an anion exchange membrane employing the plating bath of above composition, putting 0.1 g/l of NaOH in the cathodic cell of the electrolytic apparatus, using a copper plate as the anode and a stainless plate as the cathode, applying electricity at the anodic current density of 2.5 A/$dm^2$ and cathodic current density of 4 A/$dm^2$ and supplying recovered EDTA to the anodic cell. However, there could be observed no increase in the concentration of sodium sulfate.

EDTA was recovered by taking out a part of the plating bath, controlling the pH to be 14 and adding copper foil thereto so as to deposit the copper ion and remove, then adding $H_2SO_4$ to the filtrate so as to control the pH to be 2.0 and precipitate EDTA quantitatively, and filtering.

The thus obtained results are as shown hereinafter.

| Concentration of $Na_2SO_4$ | Conventional process | Our process |
|---|---|---|
| Comparison of the corner-cracking on soldering | | |
| Original | 0% | 0% |
| 0.1 M/l | 40–50% | Original physical properties are held because $Na_2SO_4$ does not increase |
| 0.3 M/l | 90–100% | |
| Electroless-copper deposition on the surface of the non-catalytic area | | |
| Original | No deposition observed | No deposition observed |
| 0.1 M/l | Deposition observed around the land | Original physical properties are held because $Na_2SO_4$ does not increase |
| 0.3 M/l | Deposition observed on soldar-resist | |
| External appearance (depositing state or the like) | | |
| Original | Deposition is fine, glossy and uniform | Deposition is fine, glossy and uniform |
| 0.1 M/l | Deposition becomes coarse and gloss deteriorates | Original physical properties are held because $Na_2SO_4$ does not increase |
| 0.3 M/l | Deposition becomes more coarse and lacks uniformity | |
| Ductility (60 × 10 × 0.05'mm) | | |
| Original 004 | 9–10% | 9–10% |
| 0.1 M/l | 5–6% | Original physical properties are held because $Na_2SO_4$ does not increase |
| 0.3 M/l | 1–2% | |
| Tensile strength (60 × 10 × 0.05'mm) | | |
| Original | 53 Kg/$mm^2$ | 53 Kg/$mm^2$ |
| 0.1 M/l | 37 Kg/$mm^2$ | Original physical properties are held because $Na_2SO_4$ does not increase |
| 0.3 M/l | 24 Kg/$mm^2$ | |

What is claimed is:

1. A process for regenerating electroless plating bath comprising the steps of:

(i) continuously or intermittently taking out a part or the whole chelating agent-containing copper electroless plating bath from an electroless plating tank, followed by removing off the copper ion content from said bath;

(ii) acidifying the thus obtained solution for precipitating the chelating agent therefrom and recovering the precipitated chelating agent;

(iii) supplying said recovered chelating agent to an anodic cell separated by an exchange membrane from a cathodic cell having cathode, said anodic cell having copper anode, wherein in case a neutral or alkaline electrolyte solution is supplied to said cathodic cell said partitioning membrane is an anion exchange membrane or cation exchange membrane, while in case an acidic electrolyte solution is supplied to said cathodic cell said partitioning membrane is a cation exchange membrane and applying direct current between both electrode; and (iv) then recycling the solution within said anodic cell to said electroless plating tank.

2. A process for regenerating electroless plating bath as claimed in claim 1, wherein the copper ion contained in said electroless copper plating bath is precipitated in the form of metal copper or copper oxide and thus removed out of said bath.

3. A process for regenerating electroless plating bath as claimed in claim 2, wherein said precipitation of copper ion is effected by adding metal copper in the electroless plating bath.

4. A process for regenerating electroless plating bath as claimed in claim 2, wherein the precipitation of copper ion is effected by alkalifying the electroless plating bath and adding metal copper thereto.

5. A process for regenerating electroless plating bath as claimed in claim 1, wherein the electroless plating bath is electrolyzed for depositing copper on a cathode and thus the copper ion is removed out of the electroless plating bath.

6. A process for regenerating electroless plating bath as claimed in claim 1, wherein said chelating agent is ethylenediaminetetraacetic acid, potassium sodium tartrate, ethylenediaminetetramine, triethanolamine or diethanolamine.

7. A process for regenerating electroless plating bath as claimed in claim 1, wherein the chelating agent is ethylenediaminetetraacetic acid.

8. A process for regenerating electroless plating bath as claimed in claim 7, wherein said ethylenediaminetetraacetic acid is precipitated by acidifying said solution up to pH 4.0 or less after removal of copper ion.

9. A process for regenerating electroless plating bath as claimed in claim 8, wherein said pH is in the order of 2.0 or less.

10. A process for regenerating electroless plating bath as claimed in claim 8, wherein the pH is in the order of 1.0 or less.

11. A process for regenerating electroless plating bath as claimed in claim 1, wherein the ion exchange membrane is an anion exchange membrane, and the cathodic cell is supplied with an alkaline electrolyte solution.

12. A process for regenerating electroless plating bath as claimed in claim 1, wherein the ion exchange membrane is a cation exchange membrane.

13. A process for regenerating electroless plating bath as claimed in claim 1, wherein the chelating agent is ethylenediaminetetraacetic acid; the solution after removal of the copper ion from the bath is acidified up to pH 2.0 or less so as to recover ethylenediaminetetraacetic acid by precipitation; and the anodic cell where copper is used as anode and the cathodic cell having cathode therein are partitioned by an anion exchange membrane, said cathodic cell being supplied with an alkaline solution, said anodic cell being supplied with the recovered ethylenediaminetetraacetic acid.

14. A process for regenerating electroless plating bath as claimed in claim 13, wherein the pH of the electrolyte solution contained in the anodic cell is in the order of 7.0 or more.

15. A process for regenerating electroless plating bath as claimed in claim 13, wherein the ethylenediaminetetraacetic acid is recovered by acidifying the solution after removal of the copper ion from the bath up to pH 1.0 or less.

16. A regenerating apparatus of electroless plating bath including (a) a copper-precipitating means for decomposing the copper chelate contained in the electroless copper plating bath and for precipitating the copper ion;

(b) a chelating agent-recovering means for changing the pH of the solution to precipitate the chelating agent and recover; and (c) an electrolytic means for preparing copper chelate comprising an anodic cell for receiving the chelating agent recovered from the said chelating agent-recovering means and a cathodic cell separated by means of an ion exchange membrane, said anodic cell having a soluble anode of copper therein, said cathodic cell having a cathode therein.

17. A process for regenerating electroless plating bath as claimed in claim 1, wherein direct current is applied between both electrodes in the range of 0.5–4.0 $A/dm^2$ of current density.

18. A process for regenerating electroless plating bath as claimed in claim 13, wherein direct current is applied between both electrodes in the range of 0.5–4.0 $A/dm^2$ of current density.

19. A process for regenerating electroless plating bath comprising the steps of:

(i) continuously or intermittently taking out a part or the whole ethylenediaminetetraacetic acid (EDTA)-containing copper electroless plating bath from an electroless plating tank, followed by removing off the copper ion content from said bath;

(ii) acidifying the thus obtained solution for precipitating EDTA therefrom and recovering the precipitted chelating agent;

(iii) supplying said recovered EDTA to an anodic cell separated by a cation exchange membrane from a cathodic cell having a cathode and an alkaline electrolyte solution therein, said anodic cell having a copper anode, wherein applying direct current between both electrodes; and (iv) then recycling the solution within said anodic cell to said electroless plating tank.

20. A process for regenerating electroless plating bath as claimed in claim 19, wherein EDTA is precipitated by acidifying said solution up to pH 2.0 or less after removal of copper ion.

21. A process for regenerating electroless plating bath as claimed in claim 19, wherein direct current is applied between both electrodes in the range of 0.5–4.0 $A/dm^2$ of current density.

22. A regenerating apparatus of electroless plating bath, as claimed in claim 16, wherein said ion exchange membrane is a cation exchange membrane.

* * * * *